US009587860B2

(12) United States Patent
Rhee et al.

(10) Patent No.: US 9,587,860 B2
(45) Date of Patent: Mar. 7, 2017

(54) CRYOCOOLER WITH VARIABLE COMPRESSION DEPENDING ON VARIATIONS IN LOAD

(71) Applicant: KOREA AEROSPACE RESEARCH INSTITUTE, Daejeon (KR)

(72) Inventors: JuHun Rhee, Daejeon (KR); Kyung-Hwan Lee, Gwangju (KR); Bum-Seok Hyun, Daejeon (KR); Eunsup Sim, Chungcheongnam-do (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 701 days.

(21) Appl. No.: 13/947,282

(22) Filed: Jul. 22, 2013

(65) Prior Publication Data

US 2014/0020409 A1 Jan. 23, 2014

(30) Foreign Application Priority Data

Jul. 23, 2012 (KR) ..... 10-2012-0079964

(51) Int. Cl.
*F25B 9/14* (2006.01)

(52) U.S. Cl.
CPC ..... *F25B 9/14* (2013.01); *F25B 2400/073* (2013.01)

(58) Field of Classification Search
CPC .... F25B 1/02; F25B 9/14; F25B 49/00; F02F 3/0023
USPC ..... 62/6
See application file for complete search history.

(56) References Cited

U.S. PATENT DOCUMENTS 4,876,945 A * 10/1989 Stoll ..... F15B 15/1457 403/296
5,146,124 A * 9/1992 Higham ..... F16F 7/116 310/17
5,502,968 A * 4/1996 Beale ..... F01B 11/00 60/520
5,535,593 A * 7/1996 Wu ..... F25B 9/14 62/228.5

FOREIGN PATENT DOCUMENTS

KR 10-2007-0017104 A 2/2007

* cited by examiner

*Primary Examiner* — Judy Swann
*Assistant Examiner* — Zachary R Anderegg
(74) *Attorney, Agent, or Firm* — Rabin & Bardo, P.C.

(57) ABSTRACT

A cryocooler, includes a cylinder filled with gas. A piston rectilinearly reciprocates inside of the cylinder and compresses or expands the gas. A connecting rod has a first side coupled to the piston and moves with the piston, and a second side having a first thread along an outer circumference thereof. A linear motor rectilinearly reciprocates a motor shaft toward the connecting rod in accordance with a control signal. A sleeve has two open sides, so that an end portion of the motor shaft can be supported by and inserted in one open side, and the second side of the connecting rod can be inserted in the other open side, and an inner circumference of the sleeve is formed with a second thread that engages with the first thread of the connecting rod and rotates to adjust a distance between the motor shaft and the connecting rod.

10 Claims, 4 Drawing Sheets

CRYOCOOLER WITH VARIABLE COMPRESSION DEPENDING ON VARIATIONS IN LOAD

CROSS-REFERENCE TO RELATED APPLICATION

This application claims priority to and the benefit of Korean Patent Application No. 10-2012-0079964 filed in the Korean Intellectual Property Office on Jul. 23, 2012, the entire contents of which are incorporated herein by reference.

BACKGROUND OF THE INVENTION (a) Field of the Invention

The present invention relates to a cryocooler with variable compressions depending on variations in load, and more particularly to a cryocooler with variable compressions, which the compressions are actively varied depending on load variations and setup temperature control information.

(b) Description of the Related Art

In a general, a cryocooler to be used in aerospace needs to have minimum power consumption since its operation has to last for a long time in astrospace. The cryocooler requires high cooling ability at its initial operation, but if it reaches to some extent a required temperature and cooling ability as times goes on and thus a temperature of a cooling section becomes lowered, the cooling ability required for keeping such a state is not high. Nevertheless, if the cooling operation is constantly continued, it is wasteful power consumption.

Accordingly, under the condition that required cooling ability is varied depending on variations in load, it is important to reduce the wasteful power consumption and secure the life of the cryocooler by gradually lowering the cooling ability when the cryocooler reaches a certain state.

To make the cooling ability of the cryocooler be variable, a driving cycle of a compressor may be adjusted, or compressing pressure may be adjusted in accordance with change in a stroke of a piston, or an inertance tube variable in length may be adjusted to have a required length. With this configuration, the wasteful power consumption is reduced to thereby increase power efficiency, and one system is enough to cover a variety of cooling ability to thereby increase utilization.

Although the cooling ability is varied due to change in operation flux and compression pressure when the compression cycle or the piston displacement is adjusted by changing a motor operation cycle of a linear motor for driving the compressor, such variation is difficult to find out an optimal point because of a matching problem between a pulse tube and the inertance tube, thereby decreasing efficiency. That is, it is difficult to deal with sizes varied depending on the respective cycles. Also, there is a limit since various changes in the length of the inertance tube are impossible.

PRIOR DOCUMENT

Korean Patent Publication No. 2007-0017104 (Feb. 8, 2007), titled 'CRYOCOOLER COLD-END ASSEMBLY APPARATUS AND METHOD'

SUMMARY OF THE INVENTION

Accordingly, the present invention is conceived to solve the forgoing problems, and an aspect of the present invention is to provide a cryocooler with variable compressions depending on variations in load, in which active variable compression control is applied to the cooling ability of the cryocooler in accordance with variations in load and cooling temperature, thereby minimizing wasteful power consumption and maximizing a cooling efficiency and the life of the cryocooler.

In accordance with an aspect of the present invention, a cryocooler with variable compressions depending on variations in load includes a cylinder 110 which is internally filled with gas; a piston 120 which rectilinearly reciprocates on an inner circumference of the cylinder 110 and compresses or expands the gas; a connecting rod 130 which comprises a first side coupled to the piston 120 and moving together with the piston 120, and a second side formed with a first thread 131 along an outer circumference thereof; a liner motor 140 which is disposed at a position opposite to a direction where the connecting rod 130 is extended, and rectilinearly reciprocates a motor shaft 141 toward the connecting rod 130 in accordance with a control signal; and a sleeve 150 which is shaped like a cylinder, both sides of which are opened, so that an end portion of the motor shaft 141 can be supported by and inserted in one open side of the sleeve 150, and the second side of the connecting rod 130 can be inserted in the other open side of the sleeve 150, and an inner circumference of the sleeve 150 is formed with a second thread 151 to be engaged with the first thread 131 of the connecting rod 130 and rotate so that a distance D between the motor shaft 141 and the connecting rod 130 can be adjusted.

The cryocooler may further comprise a rotary motor 160 which is adjacent to one side of the sleeve 150 and comprises a rotary motor shaft 161 formed a the motor shaft gear 162, wherein an outer circumference of the sleeve 150 is formed with a sleeve gear 152 engaging with and rotating together with the motor shaft gear 162.

A notch 142 may protrude from the end portion of the motor shaft 141 and is in contact with and supported by the inner circumference of the sleeve 150 so that the motor shaft 141 can be prevented from being inserted in the sleeve 150 by a predetermined length or longer.

A supporting protrusion 153 may protrude from a one-side inner circumference of the sleeve 150 so that the notch 142 of the motor shaft 141 can be in contact with and supported by the supporting protrusion 153.

The notch 142 may have an annular shape along a circumference of the end portion of the motor shaft 141.

One end portion of the sleeve 150 may be formed with a separation preventing protrusion 154 protruding inwardly to prevent the notch 142 of the motor shaft 141 inserted in the sleeve 150 from being separated outward from the sleeve 150.

The length of the second thread 151 formed on the inner circumference of the sleeve 150 may be determined within a stroke distance of the piston 120.

The cryocooler may further comprise a controller 170 which outputs a control signal for driving control of the linear motor 140 and the rotary motor 160.

The rotary motor 160 may comprise a step motor or a servo motor of which a rotating direction and a rotating angle is precisely adjusted in accordance with a control signal of the controller 170.

The controller 170 may previously store a separate data storage space with cooling temperature variation data corresponding to the compression or expansion of gas in accordance with the rotating angles of the rotary motor 160, read out the cooling temperature variation data corresponding to setting temperature control information or load variation information from the data storage space, and output a control signal for controlling the rotating direction or the rotating angle of the rotary motor 160.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF THE EMBODIMENTS

Figure 1:
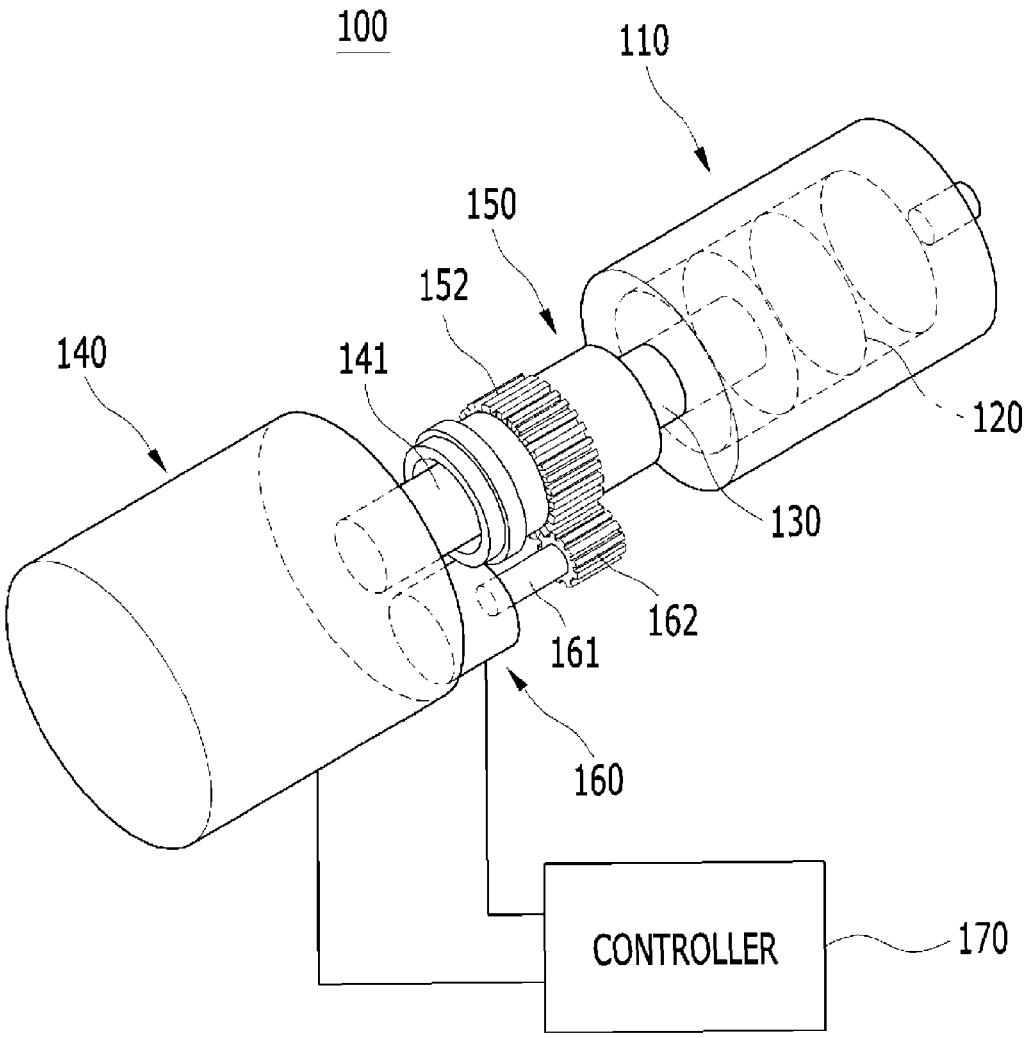
FIGS. 1 and 2 are a perspective view and a cross-section view showing a cryocooler with variable compressions depending on variations in load, according to an embodiment of the present invention.

Hereinafter, exemplary embodiments according to the present invention will be described with reference to accompanying drawings. Also, terms and words used in the following description and claims have to be interpreted by not the limited meaning of the typical or dictionary definition, but the meaning and concept corresponding to the technical idea of the present invention on the assumption that the inventor can properly define the concept of the terms in order to describe his/her own invention in the best way.

Accordingly, the disclosure in the specification and the configurations shown in the drawings are just preferred embodiments of the present invention and do not cover all the technical idea of the present invention. Thus, it should be appreciated that such embodiments may be replaced by various equivalents and modifications at a point of time when the present application is filed.

First, referring to FIGS. 1 and 2, elements and functions of a cryocooler with variable compressions depending on variations in load will be described according to an embodiment of the present invention.

The cryocooler with variable compressions depending on variations in load according to an embodiment of the present invention (hereinafter, referred to as a 'cryocooler 100') applies active variable compression control to the cooling ability of the cryocooler in accordance with variations in load and cooling temperature, thereby minimizing wasteful power consumption and maximizing a cooling efficiency and the life of the cryocooler. As shown in FIGS. 1 and 2, the cryocooler includes a cylinder 110, a piston 120, a connecting rod 130, a linear motor 140, a sleeve 150, a rotary motor 160 and a controller 170.

The cylinder 110 is an element for providing a space where gas needed for a cooling operation of the cryocooler 100 according to an embodiment of the present invention is compressed or expanded. The cylinder 110 has a sealed inner space filled with the gas, and the piston 120 is placed inside the inner space.

The piston 120 is placed inside the cylinder 110 and used for selectively compressing or expanding the gas within the sealed inner space. One side of the piston 120 compresses or expands the gas while the piston 120 rectilinearly reciprocates on an inner circumferential surface of the cylinder 110, and the other side is connected to the connecting rod 130.

The connecting rod 130 is an element which is coupled to the other side of the piston 120 and pushes or pulls the piston 120 while moving along with the rectilinear reciprocation of the linear motor 140 the piston 120, thereby transferring pressure and attraction so that the gas can be compressed or expanded by the piston 120. The connecting rod 130 has a first side coupled to the piston 120 and rectilinearly reciprocating together with the piston 120, and a second side formed with a first thread 131 along an outer circumference.

Here, the first thread 131 serves to operate by the rotation of the sleeve 150 so that the connecting rod 130 can be pulled in a direction toward or pushed in a direction opposite a motor shaft 141 of the linear motor 140.

The linear motor 140 is an element which directly presses and withdraws an end portion of the connecting rod 130 while rectilinearly reciprocating the motor shaft 141, or indirectly presses and withdraws an end portion of the connecting rod 130 through the sleeve 150. The linear motor 140 is disposed at a position opposite to a direction where the connecting rod 130 is extended, and rectilinearly reciprocates the motor shaft 141 toward the connecting rod 130 in response to a control signal.

Here, a notch 142 protrudes from the end portion of the motor shaft 141. The notch 142 is in contact with and supported by an inner circumference of the sleeve 150 and prevents the motor shaft 141 from being inserted in the sleeve 150 by a predetermined length or longer.

Figure 2:
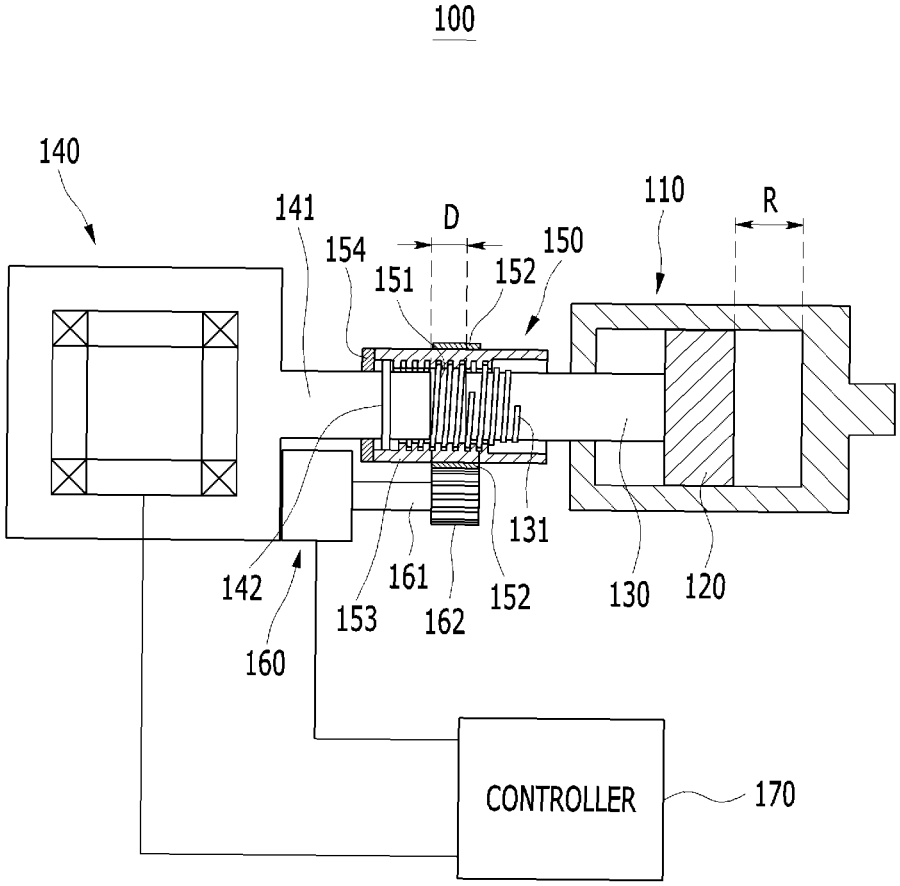
Figure 3:
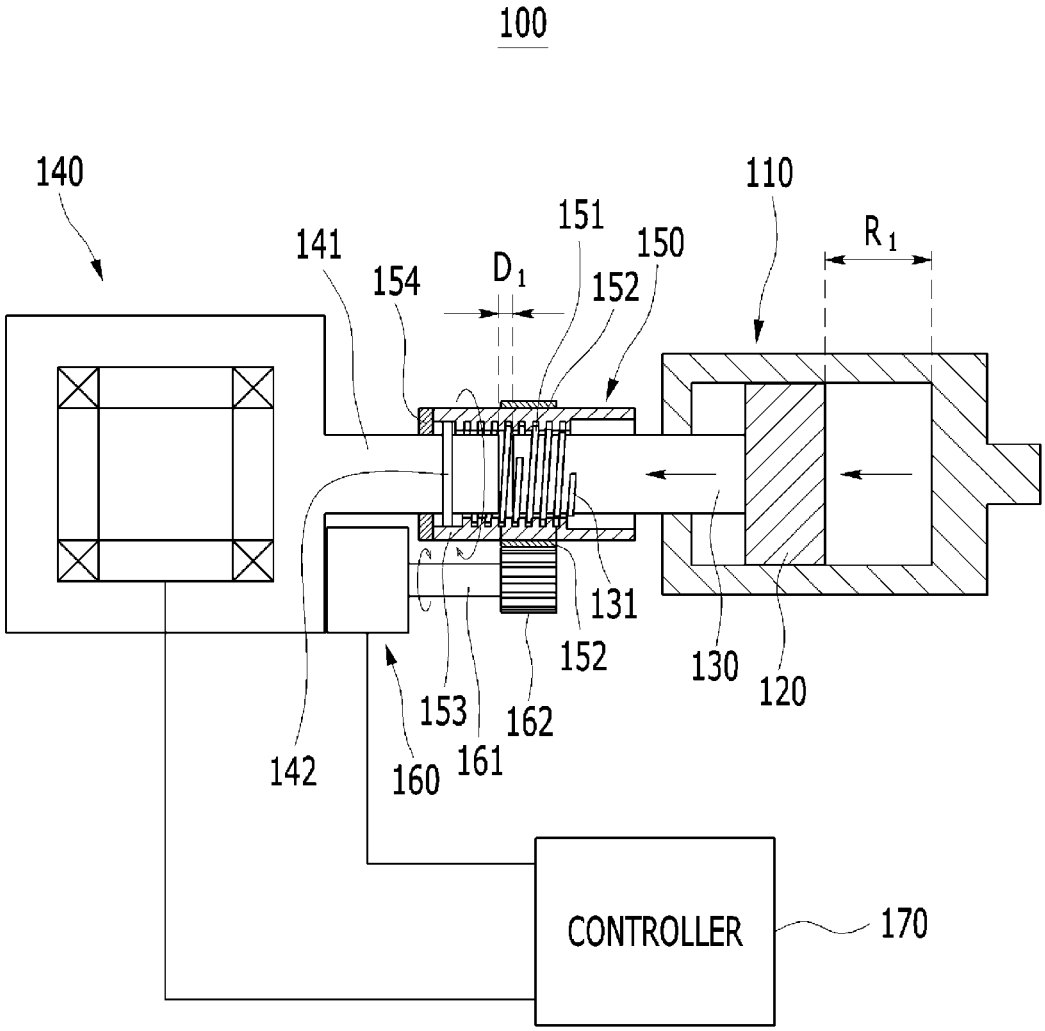
FIG. 3 is a cross-section view showing an operation principle that a gap volume R1 inside a cylinder is increased as a distance D1 between a connecting rod and a motor shaft of a linear motor is decreased by rotation of a rotary motor according to an embodiment of the present invention.
Figure 4:
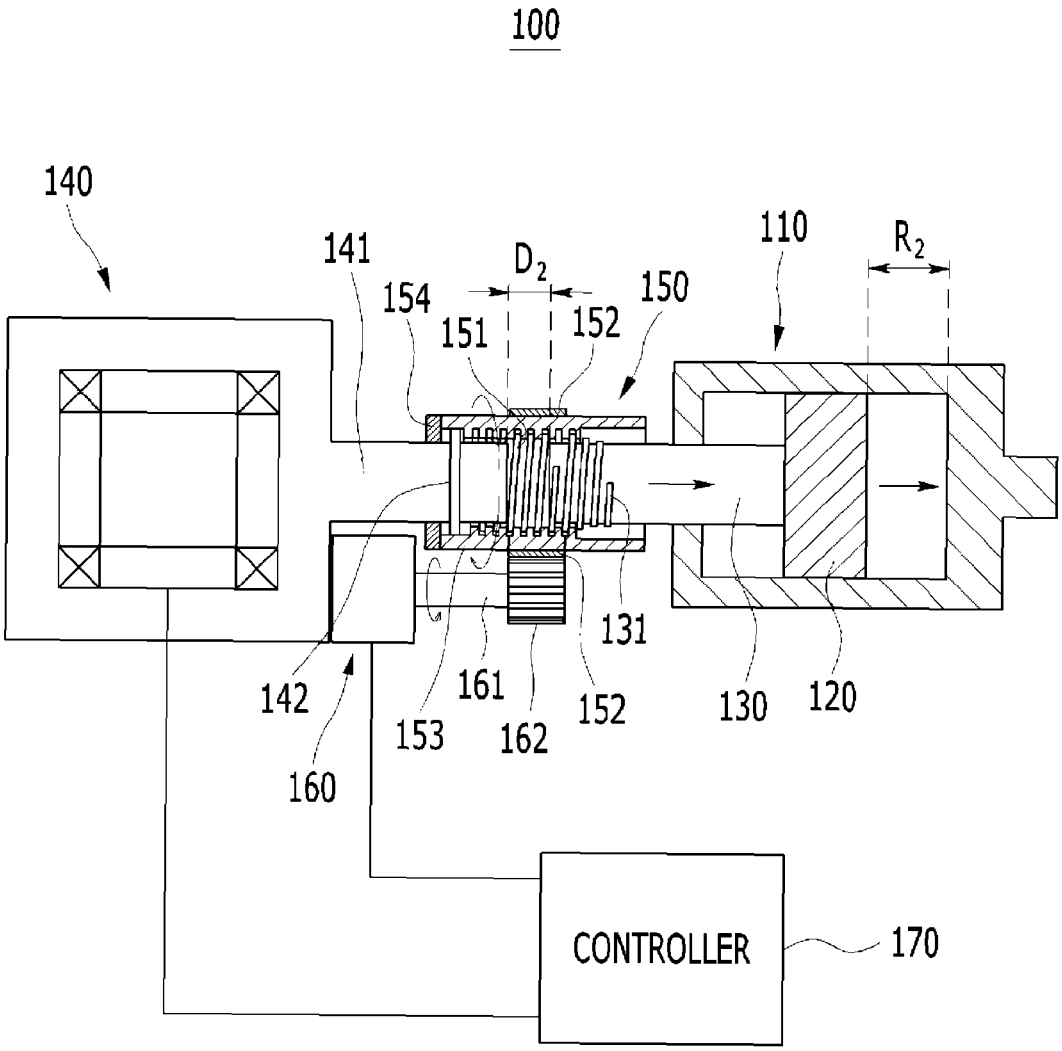
FIG. 4 is a cross-section view showing an operation principle that a gap volume R2 inside the cylinder is decreased as a distance D2 between the connecting rod and the motor shaft of the linear motor is increased by rotation of the rotary motor according to an embodiment of the present invention.

Also, the notch 142 may be provided in the form of an annular shape along the circumference of the end portion of the motor shaft 141 as shown in FIGS. 2 to 4 so as to increase an extent of being supported by the inner circumference of the sleeve 150. Thus, it is possible to more efficiently prevent the motor shaft 141 from being inserted in the sleeve 150.

The sleeve 150 is an element which is rotatably provided in the form of surrounding both the second side of the connecting rod 130 and the end portion of the motor shaft 141 of the linear motor 140, and selectively adjusts a distance D between the connecting rod 130 and the motor shaft 141 while being rotated by rotation of the rotary motor 160. The sleeve 150 is shaped like a cylinder of which both sides are opened, so that the end portion of the motor shaft 141 can be supported by and inserted in one open side of the sleeve 150, and the second side of the connecting rod 130 can be inserted in the other open side of the sleeve 150. The inner circumference of the sleeve 150 is formed with a second thread 151 to be engaged with the first thread 131 of the connecting rod 130, so that the distance D between the motor shaft 141 and the connecting rod 130 can be adjusted to increase or decrease in accordance with rotating directions of the rotary motor 160.

Here, the length of the second thread 151 formed on the inner circumference of the sleeve 150 is determined within a stroke distance of the piston 120.

Also, one end portion of the sleeve 150 may be formed with a separation preventing protrusion 154 protruding inwardly to prevent the notch 142 of the motor shaft 141 inserted in the sleeve 150 from being separated outward from the sleeve 150. Therefore, when the motor shaft 141 rectilinearly moves as being pulled toward the linear motor 140 by the linear motor 140, one side of the notch 142 formed at the end portion of the motor shaft 141 is in contact with and supported by the separation preventing protrusion 154 so that the motor shaft 141 can be prevented from being separated outward from the sleeve 150.

Further, a supporting protrusion 153 may protrude from one-side inner circumference of the sleeve 150 so that the notch 142 of the motor shaft 141 can be in contact with and supported by the supporting protrusion 153. Thus, when the motor shaft 141 is rectilinearly moved by the linear motor 140 and pressed in a direction toward the cylinder 110, the other side of the notch 142 formed at the end portion of the motor shaft 141 is in contact with and supported on the supporting protrusion 153, so that not only the pressure due to the rectilinear movement of the motor shaft 141 can be more efficiently transferred to the second side of the connecting rod 130, but also the second thread 151 of the sleeve 150 formed at a back end of the supporting protrusion 153 can be prevented from deformation and damage as being pressed by the notch 142 of the motor shaft 141.

Further, a sleeve gear 152 is formed on the outer circumference of the sleeve 150 and rotates engaging with a motor shaft gear 162 of the rotary motor 160 along the circumference so that the sleeve 150 can rotate by driving force received from the rotary motor 160.

The rotary motor 160 is an element for providing the driving force to rotate the sleeve 150. The rotary motor 160 is adjacent to one side of the sleeve 150, and comprises a rotary motor shaft 161 formed with the motor shaft gear 162 rotated engaging with the sleeve gear 152 of the sleeve 150 and driving the sleeve 150.

Here, the rotary motor 160 may be a step motor or a servo motor that can control a rotating direction and a rotating angle precisely in accordance with a control signal of the controller 170.

The controller 170 is an element for performing central control to operate the cryocooler 100 according to an embodiment of the present invention. The controller 170 outputs a control signal for controlling the operations of the linear motor 140 and the rotary motor 160 through signal lines respectively signal-connected to the linear motor 140 and the rotary motor 160.

Also, the controller 170 previously stores a separate data storage space with cooling temperature variation data corresponding to gas compression or expansion in accordance with the rotating angles of the rotary motor 160, reads the cooling temperature variation data corresponding to setting temperature control information (load information or required cooling rate information) from the data storage space, and outputs a control signal for controlling the rotating direction or the rotating angle of the rotary motor 160, thereby controlling the distance D between the motor shaft 141 of the linear motor 140 and the connecting rod 130 to be properly adjusted as the sleeve 150 rotates by the rotation of the rotary motor 160, rectilinearly moving the motor shaft 141 of the linear motor 140 toward the connecting rod 140 in the state that the distance D has been adjusted, and performing cooling control so that gas inside the cylinder 110 can be compressed by a compression ratio based on the adjustment of the distance D and be adaptive to the required cooling ability.

Next, the operation principle of the cryocooler 100 according to an embodiment of the present invention will be described with reference to FIGS. 3 and 4.

First, if required temperature and cooling ability are achieved with reference to the current temperature of the cooling section measured by an external temperature sensing means, a control signal for controlling the rotating direction or angle of the rotary motor 160 is output through a signal line connected to the rotary motor 160 by reading out cooling temperature variation data from the data storage space corresponding to temperature control information such as load information, required cooling rate information, etc. set up to maintain the current cooling level.

The rotary motor 160, which receives the control signal through the signal line, rotates in the rotating direction or at the rotating angle corresponding to the control signal. As the rotary motor 160 rotates, as shown in FIG. 3 the sleeve gear 152 of the sleeve 150 rotates engaging with the motor shaft gear 162 of the rotary motor 160, thereby rotating the sleeve 150.

The first thread 131 of the connecting rod 130 fastened matching and engaging with the second thread 151 of the sleeve 150 moves toward the end portion of the motor shaft 141 while being guided by the rotation of the second thread 151 that rotates along with the rotation of the sleeve 150, thereby decreasing the distance D1 between the end portion of the motor shaft 141 and the sleeve gear 152.

Also, as the distance D1 is decreased, the piston 120 rectilinearly moves on the inner circumference of the cylinder 110 by the attraction of the connecting rod 130, thereby increasing the gap volume R1 inside the cylinder 110.

At this time, while the distance D1 is decreased by the rotation of the sleeve 150, the end portion of the motor shaft 141 contacts the end portion of the connection rod 130 so that the pressure and attraction of the motor shaft 141 can be directly transferred. If the motor shaft 141 and the connecting rod 130 are spaced apart from each other with the distance D therebetween, the motor shaft 141 may operate to indirectly transfer its pressure and attraction to the connecting rod 130 through the sleeve 150 while the supporting protrusion 153 of the sleeve 150 is supported and pressed by the notch 142 formed at the end portion thereof.

Thus, in the state that the distance D1 has been adjusted, the controller 170 outputs a control signal for driving the linear motor 140 along the signal line connected to the linear motor 140, and the linear motor 140 receiving the control signal through the signal line operates to compress the gas inside the cylinder 110 at the compression ratio based on the gap volume R1 increased while the connecting rod 130 is pressed by rectilinearly moving the motor shaft 141.

When the piston 120 compresses the gas, the temperature of gas is increased. Therefore, an aftercooler dissipates heat peripherally, thereby decreasing the temperature. Since increased pressure of the system is higher than pressure of a gas reservoir, the gas moves to the gas reservoir at the end of the system. Also, a matrix of the regenerator absorbs heat from the gas while the gas passes by a regenerator and precooling is performed before entering a low temperature section of the pulse tube. Further, as the pressure of working gas is increased at a portion of the pulse tube, the temperature of gas is also increased. The gas is introduced into the gas reservoir while passing by a high temperature heat exchanger, thereby additionally dissipating heat peripherally.

Meanwhile, if required temperature and cooling ability are not achieved with reference to the current temperature of the cooling section measured by the external temperature sensing means, a control signal for controlling the rotating direction or angle of the rotary motor 160 is output through the signal line connected to the rotary motor 160 by reading out the cooling temperature variation data from the data storage space corresponding to temperature control information such as load information, required cooling rate information, etc. set up to perform cooling at a temperature lower than the current cooling level.

The rotary motor 160, which receives the control signal through the signal line, rotates in the rotating direction or at the rotating angle corresponding to the control signal. As the rotary motor 160 rotates, as shown in FIG. 4 the sleeve gear 152 of the sleeve 150 rotates engaging with the motor shaft gear 162 of the rotary motor 160, thereby rotating the sleeve 150.

The first thread 131 of the connecting rod 130 fastened matching and engaging with the second thread 151 of the sleeve 150 moves toward the cylinder 110 while being guided by the rotation of the second thread 151 that rotates along with the rotation of the sleeve 150, thereby increasing the distance D2 between the end portion of the motor shaft 141 and the sleeve gear 152.

Also, as the distance D2 is increased, the piston 120 rectilinearly moves on the inner circumference of the cylinder 110 by the pressure of the connecting rod 130, thereby decreasing the gap volume R2 inside the cylinder 110.

Thus, in the state that the distance D2 has been adjusted, the controller 170 outputs a control signal for driving the linear motor 140 along the signal line connected to the linear motor 140, and the linear motor 140 receiving the control signal through the signal line operates to compress the gas inside the cylinder 110 at the compression ratio based on the gap volume R2 decreased while the connecting rod 130 is pressed by rectilinearly moving the motor shaft 141.

With the foregoing configurations and functions of the cryocooler 100 according to an embodiment of the present invention, active variable compression control is applied to the cooling ability of the cryocooler 100 in accordance with variations in load and cooling temperature, thereby minimizing wasteful power consumption and maximizing a cooling efficiency and the life of the cryocooler.

Also, only performance change is shown corresponding to variations in flux pressure of gas, and thus there is no need of changing the pulse tube or the inertance tube in accordance with displacements. Therefore, it is advantageous to change the cooling ability. Further, when it reaches a temperature needed for Cold End, no more additional cooling ability is needed and only power for maintenance of status quo. To this end, the stroke of the piston 120 is adjusted, i.e., the gap volume R is expanded by adjusting the distance D between the motor shaft 141 of the linear motor 140 and the connecting rod 130 connecting with the piston 120 through the sleeve 150, thereby decreasing the compression ratio and thus decreasing the compression pressure. Then, the linear motor 140 can operate the compressor with less power as needed, thereby minimizing the wasteful power consumption and maximizing efficiency.

According to an embodiment of the present invention, the a cryocooler with variable compressions depending on variations in load has the following effects.

First, active variable compression control is applied to the cooling ability of the cryocooler 100 in accordance with variations in load and cooling temperature, thereby minimizing wasteful power consumption and maximizing a cooling efficiency and the life of the cryocooler.

Second, it is advantageous to change the cooling ability because only performance change is shown corresponding to variations in flux pressure of gas, and thus there is no need of changing the pulse tube or the inertance tube in accordance with displacements.

Third, when it reaches a temperature needed for Cold End, no more additional cooling ability is needed and only power for maintenance of status quo. To this end, the stroke of the piston 120 is adjusted, i.e., the gap volume R is expanded by adjusting the distance D between the motor shaft 141 of the linear motor 140 and the connecting rod 130 connecting with the piston 120 through the sleeve 150, thereby decreasing the compression ratio and thus decreasing the compression pressure. Then, the linear motor 140 can operate the compressor with less power as needed, thereby minimizing the wasteful power consumption and maximizing efficiency.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A cryocooler with variable compressions for cooling operation depending on variations in load, the cryocooler comprising:

a cylinder (110) which is internally filled with gas;

a piston (120) which rectilinearly reciprocates on an inner circumference of the cylinder (110) and compresses or expands the gas;

a connecting rod (130) which comprises a first side coupled to the piston (120) and moving together with the piston (120), and a second side formed with a first thread (131) along an outer circumference thereof;

a linear motor (140) which is disposed at a position opposite to a direction where the connecting rod (130) is extended, and rectilinearly reciprocates a motor shaft (141) toward the connecting rod (130) in accordance with a control signal; and a sleeve (150) which is formed in a cylindrical shape, both sides of which are opened, so that an end portion of the motor shaft (141) can be is supported by and inserted in a first open side of the sleeve (150), and the second side of the connecting rod (130) can be is inserted in a second open side of the sleeve (150), and an inner circumference of the sleeve (150) is formed with a second thread (151) to be engaged with the first thread (131) of the connecting rod (130), wherein, as the sleeve is rotated, the first thread (131) of the connecting rod (130) is guided by rotation of the second thread (151), such that a distance (D) between the end portion of the motor shaft (141) and the second side of the connecting rod (130) is adjusted.

2. A cryocooler with variable compressions for cooling operation depending on variations in load, the cryocooler comprising:

a cylinder (110) which is internally filled with gas;

a piston (120) which rectilinearly reciprocates on an inner circumference of the cylinder (110) and compresses or expands the gas;

a connecting rod (130) which comprises a first side coupled to the piston (120) and moving together with the piston (120), and a second side formed with a first thread (131) along an outer circumference thereof;

a linear motor (140) which is disposed at a position opposite to a direction where the connecting rod (130) is extended, and rectilinearly reciprocates a motor shaft (141) toward the connecting rod (130) in accordance with a control signal; and a sleeve (150) which is formed in a cylindrical shape, both sides of which are opened, so that an end portion of the motor shaft (141) is supported by and inserted in a first open side of the sleeve (150), and the second side of the connecting rod (130) is inserted in a second open side of the sleeve (150), and an inner circumference of the sleeve (150) is formed with a second thread (151) to be engaged with the first thread (131) of the connecting rod (130), wherein the connecting rod (130) moves rectilinearly together with the piston (120) relative to the sleeve (150), such that a distance (D) between the end portion of the motor shaft (141) and the second side of the connecting rod (130) is adjusted.

3. The cryocooler according to claim 1, further comprising a rotary motor (160) which is adjacent to the sleeve (150) and comprises a rotary motor shaft (161) formed with a motor shaft gear (162), wherein an outer circumference of the sleeve (150) is formed with a sleeve gear (152) engaging with and rotating together with the motor shaft gear (162).

4. The cryocooler according to claim 1, wherein a notch (142) protrudes from the end portion of the motor shaft (141) and is in contact with and supported by the inner circumference of the sleeve (150) so that the motor shaft (141) is prevented from being inserted in the sleeve (150) by a predetermined length or longer.

5. The cryocooler according to claim 4, wherein a supporting protrusion (153) protrudes from a one-side inner circumference of the sleeve (150) so that the notch (142) of the motor shaft (141) is allowed to be in contact with and supported by the supporting protrusion (153).

6. The cryocooler according to claim 5, wherein the notch (142) has an annular shape along a circumference of the end portion of the motor shaft (141).

7. The cryocooler according to claim 6, wherein one end portion of the sleeve (150) is formed with a separation-preventing protrusion (154) protruding inwardly to prevent the notch (142) of the motor shaft (141) inserted in the sleeve (150) from being separated outward from the sleeve (150).

8. The cryocooler according to claim 1, wherein a length of the second thread (151) formed on the inner circumference of the sleeve (150) is within a stroke distance of the piston (120).

9. The cryocooler according to claim 1, further comprising a controller (170) which outputs a control signal for driving control of the linear motor (140) and a rotary motor (160).

10. The cryocooler according to claim 9, wherein the rotary motor (160) comprises a step motor or a servo motor of which a rotating direction and a rotating angle is adjustable in accordance with a control signal of the controller (170).

* * * * *